US008875365B2

(12) United States Patent
Huseman et al.

(10) Patent No.: US 8,875,365 B2
(45) Date of Patent: Nov. 4, 2014

(54) TONGS WITH LOW TORQUE AT HIGH PRESSURE

(76) Inventors: Jonathan V. Huseman, Midland, TX (US); Kasia L. Robnett, Midland, TX (US); Frederic M. Newman, Midland, TX (US)

( * ) Notice: Subject to any disclaimer, the term of this patent is extended or adjusted under 35 U.S.C. 154(b) by 377 days.

(21) Appl. No.: 13/452,278

(22) Filed: Apr. 20, 2012

(65) Prior Publication Data

US 2013/0276291 A1 Oct. 24, 2013

(51) Int. Cl.

| | |
|---|---|
| ***B23P 19/04*** | (2006.01) |
| ***B21D 39/04*** | (2006.01) |
| ***B23Q 17/00*** | (2006.01) |
| ***B23P 19/00*** | (2006.01) |
| ***B23Q 7/00*** | (2006.01) |
| ***B25B 23/151*** | (2006.01) |
| ***B25B 23/00*** | (2006.01) |
| ***B25B 13/50*** | (2006.01) |
| ***E21B 19/16*** | (2006.01) |

(52) U.S. Cl.

CPC ..... *E21B 19/164* (2013.01); *E21B 19/165* (2013.01)

USPC ..... 29/407.02; 29/240; 29/282; 29/407.05; 29/456; 81/469; 81/470; 81/57.11; 81/57.16; 81/57.19; 81/57.2; 81/57.33; 81/57.34; 81/57.35

(58) Field of Classification Search

USPC ..... 29/240, 240.5, 282, 407.02, 407.05, 29/428, 456, 559; 81/57.11, 57.39, 469, 81/470, 57.14, 57.16, 57.18, 57.19, 57.2, 81/57.21, 57.33–57.35; 269/32, 24

See application file for complete search history.

(56) References Cited

U.S. PATENT DOCUMENTS

| | | | | |
|---|---|---|---|---|
| 3,691,875 | A | 9/1972 | Geczy et al. | |
| 3,704,638 | A | 12/1972 | Nicolson et al. | |
| 3,706,243 | A | 12/1972 | Wilms | |
| 3,719,236 | A | 3/1973 | Smith, Jr. et al. | |
| 3,719,237 | A | 3/1973 | Flick | |
| 4,084,429 | A * | 4/1978 | Boland | 73/862.25 |
| 4,084,453 | A * | 4/1978 | Eckel | 81/57.18 |
| 4,089,240 | A * | 5/1978 | Eckel | 81/57.18 |
| 4,215,602 | A | 8/1980 | Carstensen et al. | |
| 4,333,365 | A | 6/1982 | Perry | |

(Continued)

OTHER PUBLICATIONS

Cavins; Oil Well Tools; admitted published prior art; Long Beach, CA; www.cavins.com; 32 pages.

(Continued)

*Primary Examiner* — Essama Omgba
*Assistant Examiner* — Darrell C Ford
(74) *Attorney, Agent, or Firm* — www.bobharter.com; Robert J. Harter

(57) ABSTRACT

A tongs system and method for making and breaking threaded joints of a string of tubing for an oil well involves, in some examples, the use of a set of tongs with a two-speed transmission and a hydraulic system selectively operable in a high-pressure mode and a low-pressure mode. During an initial tightening period, the tongs system operates in high-gear and high-pressure for maximum speed. During a subsequent final tightening period, the tongs system operates in low-gear and low-pressure to controllably tighten the joint to a predetermined target torque. In some examples, to allow the transmission to shift speed without jamming gears, the tongs system pauses for an instant between the initial and final tightening periods. In some examples, the tongs system is interlocked with a hoist and/or other tube-holding and handling equipment.

17 Claims, 6 Drawing Sheets

(56) References Cited

U.S. PATENT DOCUMENTS

| | | | | | |
|---|---|---|---|---|---|
| 4,334,444 | A | | 6/1982 | Carstensen et al. | |
| 4,346,629 | A | | 8/1982 | Kinzbach | |
| 4,401,000 | A | | 8/1983 | Kinzbach | |
| 4,465,422 | A | | 8/1984 | Blust, Sr. et al. | |
| 4,579,024 | A | | 4/1986 | Coyle, Sr. | |
| 4,593,584 | A | | 6/1986 | Neves | |
| 4,679,469 | A | * | 7/1987 | Coyle, Sr. | 81/470 |
| 4,715,253 | A | * | 12/1987 | Falgout et al. | 81/57.14 |
| 4,938,109 | A | | 7/1990 | Torres et al. | |
| RE33,526 | E | * | 1/1991 | Coyle, Sr. | 81/470 |
| 6,082,225 | A | * | 7/2000 | Richardson | 81/57.16 |
| 6,276,449 | B1 | * | 8/2001 | Newman | 166/53 |
| 6,334,376 | B1 | | 1/2002 | Torres | |
| 6,374,706 | B1 | | 4/2002 | Newman | |
| 7,028,787 | B2 | * | 4/2006 | Allen et al. | 175/162 |
| 8,074,537 | B2 | | 12/2011 | Hunter | |
| 8,109,179 | B2 | * | 2/2012 | Richardson | 81/57.11 |
| 8,141,459 | B2 | * | 3/2012 | Myburgh | 81/57.11 |
| 2003/0075023 | A1 | * | 4/2003 | Robichaux | 81/57.37 |
| 2008/0060481 | A1 | * | 3/2008 | Hunter | 81/57.11 |
| 2008/0307930 | A1 | * | 12/2008 | Veverica et al. | 81/57.34 |
| 2009/0101332 | A1 | * | 4/2009 | Shahin et al. | 166/77.51 |
| 2012/0325017 | A1 | * | 12/2012 | Ruehmann et al. | 73/862.21 |
| 2013/0255446 | A1 | * | 10/2013 | Taggart | 81/57.11 |

OTHER PUBLICATIONS

Weatherford; Oil Country Manufacturing catalog; admitted published prior art; 2004; Houston, TX; www.weatherford.com; 32 pages.

* cited by examiner

TONGS WITH LOW TORQUE AT HIGH PRESSURE

FIELD OF THE INVENTION

The subject invention generally pertains to oil wells and other wells, and more specifically to a tool for assembling and disassembling a string of tubing for such wells.

BACKGROUND

Oil wells and wells for other fluids typically include a well casing, a string of tubing, sucker rods and a reciprocating drive unit. A well casing is what lines the well bore and usually comprises a long string of relatively large diameter pipe interconnected by threaded couplings known as collars. Casings generally define the overall diameter and depth of a well bore. Well tubing typically comprises a long string of pipe sections with threaded ends that also are interconnected by threaded couplings. The tubing extends down through the casing and provides a conduit for conveying oil or some other fluid to the surface of the well. A submerged reciprocating pump attached to the lower end of the tubing draws the fluid from the annulus between the inside diameter of the casing and the outside diameter of the tubing and forces the fluid up through the tubing to the surface. To operate the pump, a string of sucker rods extends through the tubing to serve as a long reciprocating connecting rod that couples the submerged pump to a reciprocating drive unit at ground level. A string of sucker rods typically includes numerous sucker rods with ends that are interconnected by threaded rod couplings.

Servicing oil wells and other types of wells can involve a variety of tasks that include, but are not limited to, installing or removing sections of casing, sucker rods, tubing and pumps. Removing and installing a string of tubing, for example, typically involves the use of a hoist for handling the tubing and a set of hydraulic tongs for making or breaking the threaded tubing joints (tubular connections). Various other known equipment can also used to facilitate the servicing of wells.

DETAILED DESCRIPTION

Figure 1:
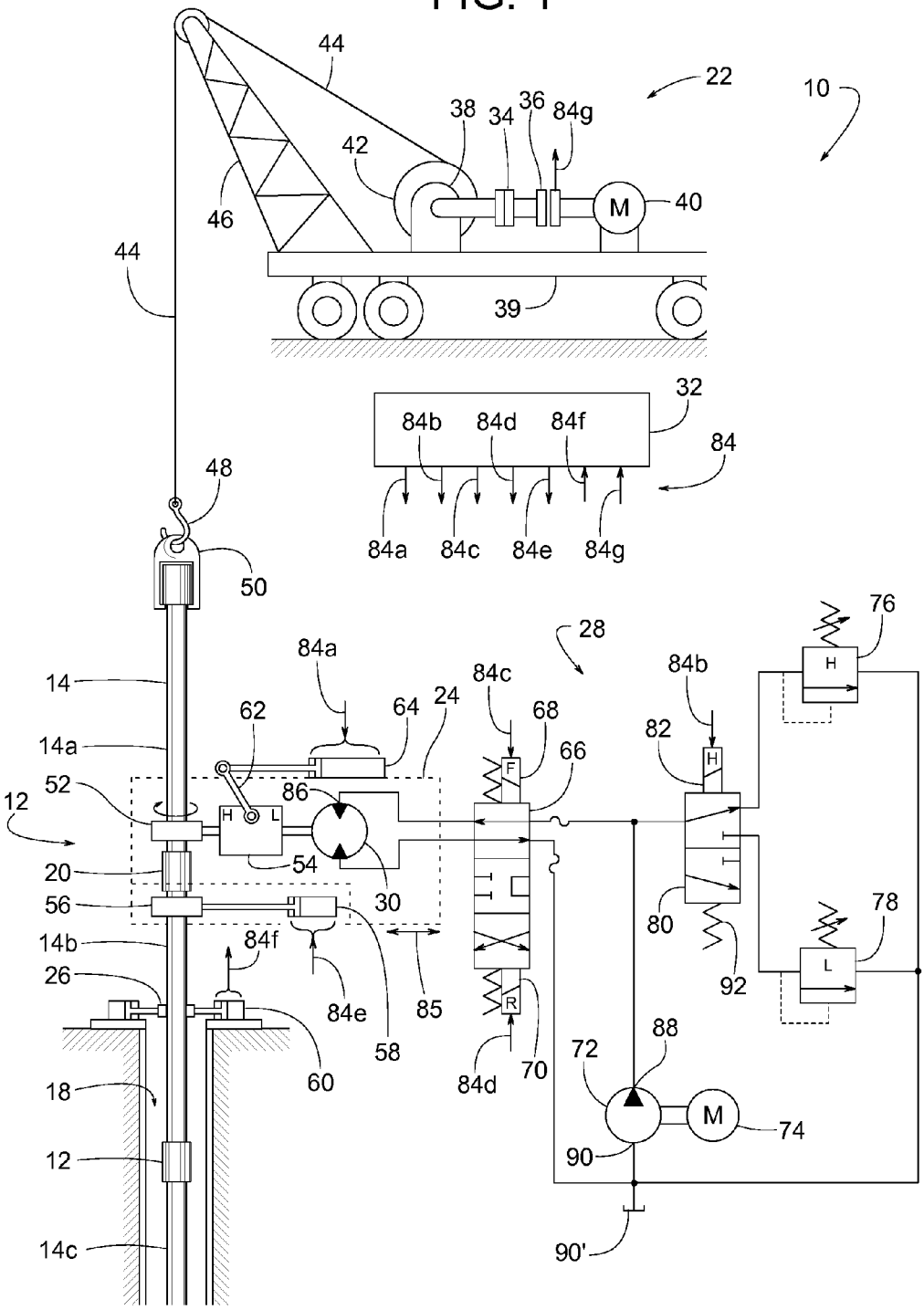
FIG. 1 is a schematic diagram showing an example tongs system and method during an initial tightening period.
Figure 2:
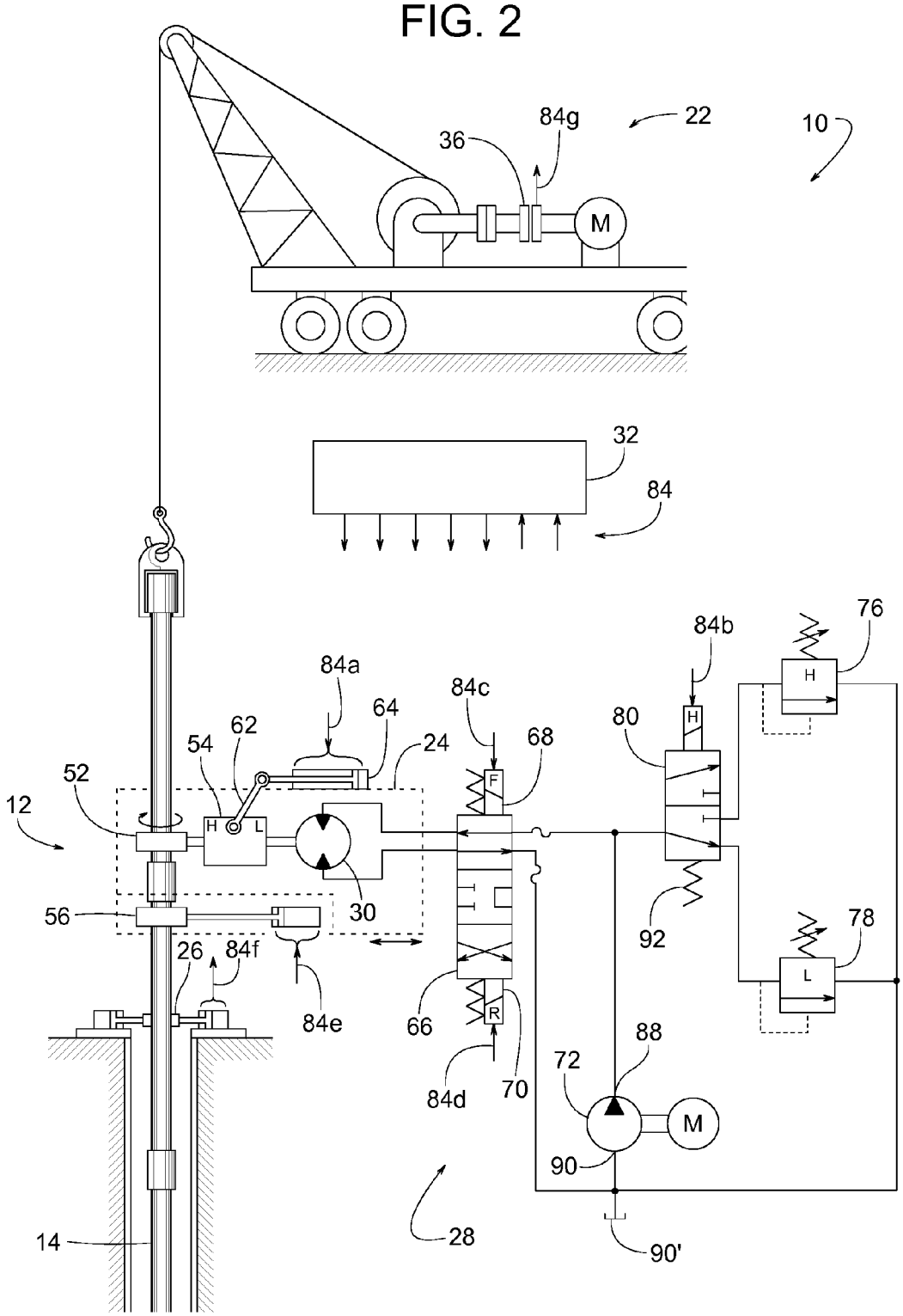
FIG. 2 is a schematic diagram similar to FIG. 1 but showing the tongs system and method during a final tightening period.
Figure 3:
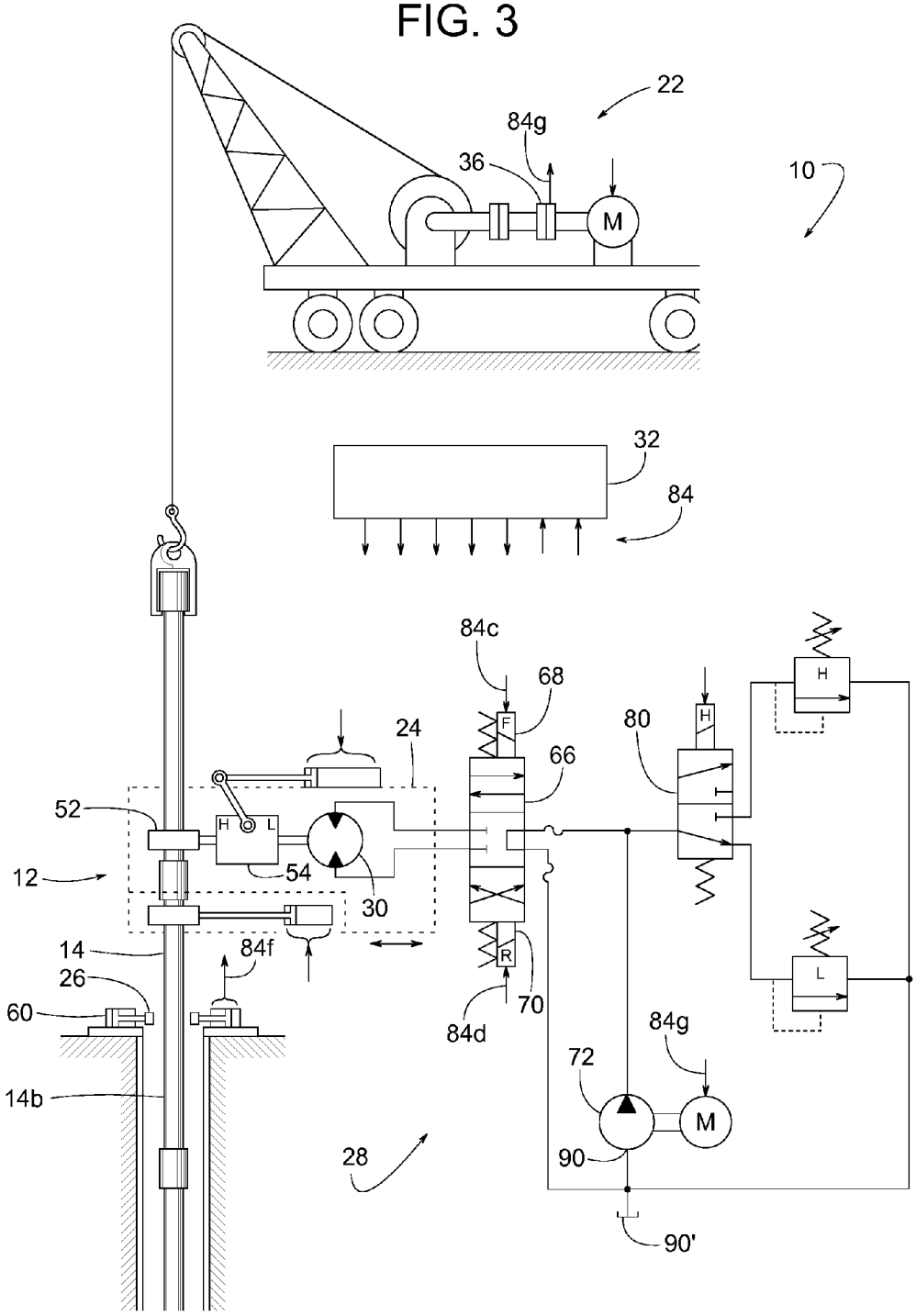
FIG. 3 is a schematic diagram similar to FIGS. 1 and 2 but showing the tongs system and method in a state of interlock.
Figure 4:
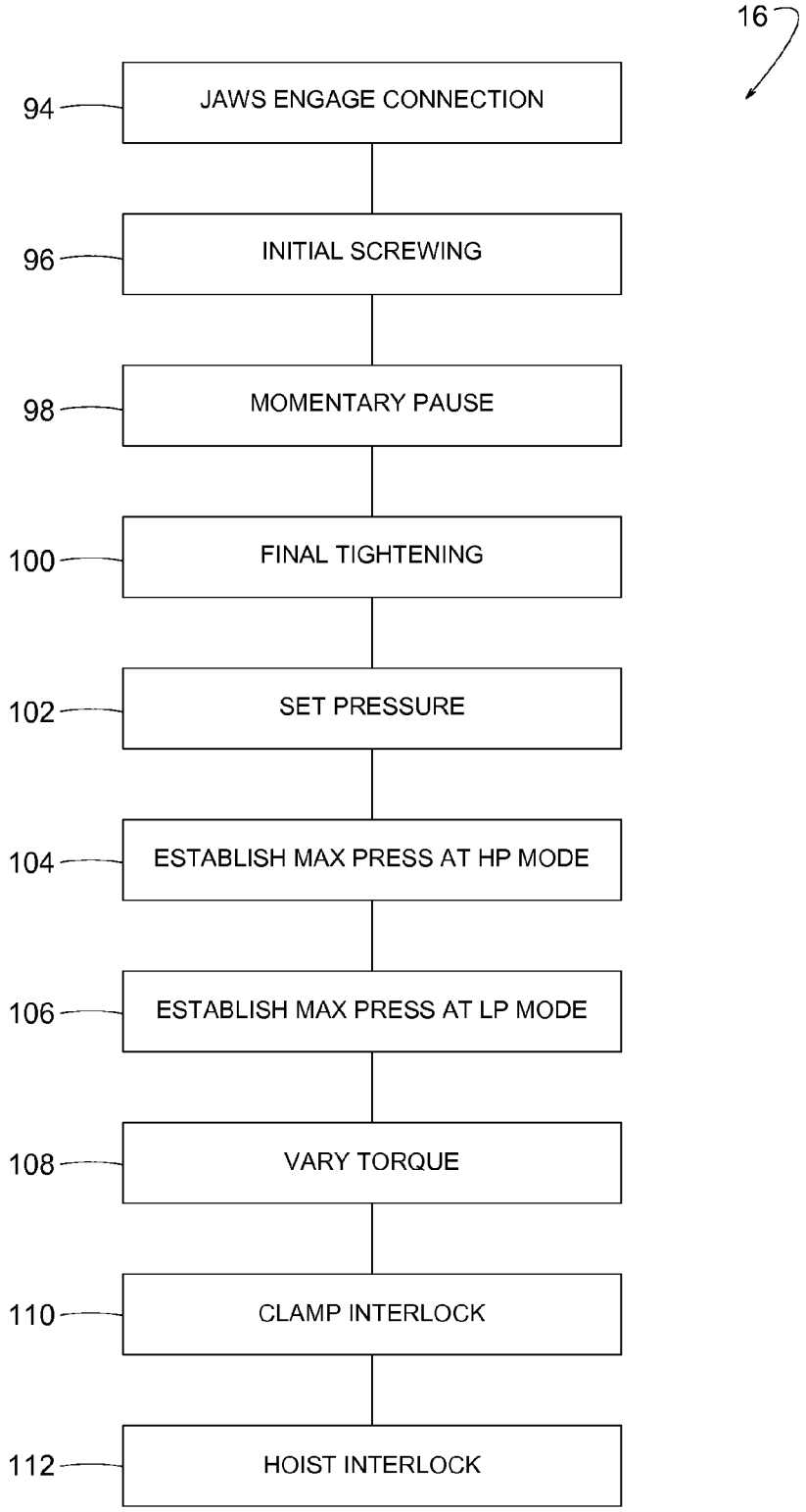
FIG. 4 is a block diagram illustrating various actions associated with the example tongs system and method of FIG. 1.

FIGS. 1-3, with further reference to FIGS. 4-7, illustrate an example tong system 10 with special means for efficiently making and breaking tubular connections 12 of a string of well tubing 14, and FIG. 4 illustrates an example method of operation 16 of system 10. Tubing string 14 provides an assembled pipeline for conveying oil or some other fluid up from within an in-ground wellbore 18. For the illustrated example, well tubing 14 comprises a series of tubes 14*a*, 14*b*, 14*c*, etc., screwed together, either directly or by way of a series of internally threaded couplings 20. In either case, the resulting threaded joint is referred to as tubular connection 12.

In some examples, each tube (e.g., tube 14*b*) has external and internal threads at opposite ends, which allow the tubes to be screwed together directly without a separate intermediate coupling 20. In perhaps the most common example, however, each tube (e.g., tube 14*b*) has external threads at either end that screw into internally threaded coupling 20. In such an example, tubular connection 12 comprises, for example, upper tube 14*a*, lower tube 14*b* and coupling 20. The expression, "engaging the tubular connection" means engaging at least one of the connection's components, e.g., tube 14*a*, tube 14*b* and/or coupling 20. The terms, "making a tubular connection" and "make up" means screwing together one tube to another, directly or via coupling 20. The terms, "breaking a tubular connection" and "break out" means unscrewing the connection.

Some example equipment used in tong system 10 include a hoist 22 for raising and lowering tubing string 14 and for adding or removing tubes, a tongs tool 24 for making and breaking tubular connection 12, a clamp 26 (also known as a slip or slips) for temporarily holding a partially assembled tubing string 14 in suspension within wellbore 18, a hydraulic system 28 for powering a reversible hydraulic motor 30 of tongs tool 24, and a controller 32 for controlling various operations of tongs system 10.

Hoist 22, in some examples, comprises a brake 34, a clutch 36 and a hoist transmission 38 coupling a motor 40 (e.g., hydraulic motor, electric motor, engine, prime mover of a service rig vehicle 39, etc.) to a cable drum 42. Hoist transmission 38 is schematically illustrated to represent any known means for completing the drive connection between motor 40 and drum 42. Examples of hoist transmission 38 include, but are not limited to, gears, shafts, sprockets, sheaves, belts, chains, and various combinations thereof. Drum 42 feeds a cable 44 over a derrick mast 46 to a block and hook 48 with a releasable elevator 50 that can suspend at least a portion of tubing string 14 from derrick mast 46. The drum's rotational direction determines whether hoist 22 lifts or lowers hook 48. Brake 34 selectively holds and releases drum 42 with respect to the drum's rotation. Clutch 36 selectively engages and releases the output of motor 40 to drum 42. In some examples, hoist 22 is mounted to service rig vehicle 39. In other examples, hoist 22 is mounted to a more permanent structure.

Tongs tool 24, in some examples, comprises a rotatable set of jaws 52 for grippingly engaging tubular connection 12 (e.g., clamping onto tube 14*a* or clamping onto coupling 20), hydraulic motor 30 for powering the rotation of jaws 52 in a forward or reverse direction, and a transmission 54 for transmitting the rotational power of motor 30 to jaws 52. One example of tongs tool 24 is a BJ Hughes Model RS series hydraulic tubing tongs provided by Baker Hughes Incorporated of Houston, Tex. Other examples of tongs tool 24 include, but are not limited to, models similar to the BJ Model RS but provided by other companies such as Cavins Oil Well Tools, of Long Beach Calif. and Weatherford International Ltd. of Switzerland. Some examples of tongs tool 24 also include an add-on backup set of jaws 56 for holding a lower portion of tubular connection 12 stationary relative to jaws 52. Examples of backup jaws 56 intended for use with BJ Model RS style tongs are also provided by companies such as Baker Hughes, Cavins and Weatherford. In the illustrated example, an actuator 58 selectively clamps and unclamps backup jaws 56 with respect to the tubular connection's lower portion (e.g., lower tube 14*b* or coupling 20).

Alternatively or in addition to backup set of jaws 56, clamp 26 or some other means are used for holding the tubular connection's lower portion stationary. In the illustrated example, clamp 26 is below and spaced apart from tongs tool 24. A manually or automatically controlled actuator 60 (e.g., pneumatic cylinder, hydraulic cylinder, etc.) moves clamp 26 between its clamp position (FIGS. 1 and 2) and its release position (FIG. 3). In the clamp position, clamp 26 tightly grips tube 14*b* to help prevent tubing string 14 from falling or rotating. Clamp 26 in the unclamp position releases tube 14*b*, which allows hoist 22 to lift or lower tubing string 14.

Referring to FIGS. 1, 2, 5 and 6, to enable tongs tool 24 to rapidly screw together tubular connections during an initial tightening period (FIG. 1 and period 25 of FIG. 6) and to exert sufficient torque during a final tightening period (FIG. 2 and period 27 of FIG. 6), transmission 54 is at least a two-speed transmission rendering tongs tool 24 selectively operable in a high-gear mode (FIG. 1 and line 29 of FIG. 5) during period 25 and a low-gear mode (FIG. 2 and line 31 of FIG. 5) during period 27. Moving a lever 62 from the position of FIG. 2 to that of FIG. 1 shifts tongs tool 24 from low-gear mode 31 to high-gear mode 29. Transmission 54 provides a speed ratio of jaws speed (jaws 52) to motor speed (motor 30) that is higher in the high-gear mode than in the low-gear mode. In other words, for a given rotational speed of motor 30, jaws 52 rotates faster in high-gear mode 29 than in low-gear mode 31. In the illustrated example, an actuator 64 (e.g., pneumatic cylinder, hydraulic cylinder, etc.) is what moves lever 62 between its high and low gear positions.

In some examples, tongs tool 24 includes a directional valve 66 for selectively stopping jaws 52 and for determining the forward/reverse rotational direction of jaws 52. An example of valve 66 includes, but is not limited to, a 4-way, 3-position valve with a spring biased neutral/stop central position. A forward rotation actuator 68 and a reverse rotation actuator 70 determine the off center shifted position of valve 66 and thus determine the rotational direction of jaws 52 for making and breaking tubular connections 12. Although actuators 68 and 70 are shown as solenoids, other examples of actuators 68 and 70 include, but are not limited to, those that are pneumatically or hydraulically actuated.

To screw tubular connection 12 together at maximum speed during initial tightening period 25 and to a predetermined torque during final tightening period 27, hydraulic system 28, which powers tongs motor 30, selectively operates in a high-pressure mode (FIG. 1) during initial tightening period 25 and low-pressure mode (FIG. 2) during final tightening period 27. It should be noted, however, that to prevent over tightening during initial tightening period 25 and to ensure sufficient tightening during the final tightening period 27, tongs tool 24 operates in high-gear mode 29 when hydraulic system 28 is in the high-pressure mode, as shown in FIG. 1, and tongs tool 24 operates in low-gear mode 31 when hydraulic system 28 is in the low-pressure mode, as shown in FIG. 2.

To achieve such operation, hydraulic system 28, in some examples, comprises a hydraulic pump 72 (driven by a motor 74), a high-pressure relief valve 76, a low-pressure relief valve 78, and a selector valve 80 for selectively activating valves 76 and 78. The terms, "high-pressure" and "low-pressure" do not refer to any certain absolute pressure values, but rather the terms are relative in that "high-pressure" is higher than "low-pressure." Motor 74 is schematically illustrated to represent any means for driving hydraulic pump 72. Examples of motor 74 include, but are not limited to, an electric motor, hydraulic motor, engine, prime mover of service rig vehicle 39, etc. In the example illustrated in FIGS. 1-3, selector valve 80 is a 3-way 2-position valve with spring return for urging valve 80 to its normal position shown in FIGS. 2 and 3. An actuator 82 (e.g., solenoid, pneumatic, hydraulic, etc.) shifts valve 80 from its spring-biased normal position of FIGS. 2 and 3 to its shifted position of FIG. 1. The activation of actuator 82 and one or more various other components of system 10 is achieved through controller 32. In some embodiments, some components of system 10 are manually controlled or actuated, wherein examples of such components include, but are not limited to, one or more of the following: clamp 26, actuator 60, clutch 36, brake 34, motor 40 and motor 74.

Controller 32 is schematically illustrated to represent any means for employing a plurality of control signals 84 in a predetermined manner and/or in response to various inputs. Examples of controller 32 include, but are not limited to, one or more PLCs (programmable logic controllers), one or more computers, one or more microprocessors, one or more electrical circuits, and various combinations thereof. In some examples, controller 32 employs one or more of the following signals: a signal 84*a* for shifting transmission 54 between the high-gear mode (FIG. 1 and line 29 of FIG. 5) and the low-gear mode (FIG. 2 and line 31 of FIG. 5), a signal 84*b* for selectively activating the high-pressure mode (FIG. 1) and the low-pressure mode (FIG. 2), a signal 84*c* for operating tongs tool 24 in the forward or tightening direction, a signal 84*d* for operating tongs tool 24 in the reverse or untightening direction, an absence of signals 84*c* and 84*d* for stopping tongs tool 24, a signal 84*e* for selectively clamping or releasing backup jaws 56, a signal 84*f* for determining the position or state of clamp 26, and a signal 84*g* for determining the activation of clutch 36.

Some example operations of tong system 10 are illustrated in FIGS. 1-6. FIG. 1 shows tong system 10 operating in the initial tightening period 25 to begin making tubular connection 12. Signal 84*g* confirms that clutch 36 is disengaged. Signal 84*f* determines that clamp 26 is in its clamped position. An arrow 85 represents tongs tool 24 being positioned in relation to tubular connection 12. Signal 84*e* sets backup jaws 56 to its clamping configuration. Signal 84*a* sets tongs tool 24 in high-gear mode 29. Signal 84*c* ensures that motor 30 of tongs tool 24 is set to run in the forward, tightening direction, wherein valve 66 connects a first fluid inlet 86 of motor 30 in fluid communication with a discharge 88 of pump 72. Signal 84*b* sets hydraulic system 28 in the high-pressure mode by activating high-pressure relief valve 76 and effectively taking low-pressure relief valve 78 out of the circuit. High-pressure relief valve 76, in some examples, is set at 2,000 psi (selected maximum pressure), thus hydraulic pressure at pump discharge 88 can vary, due to friction in connection 12 and other physical variables (e.g., rotational inertia), but the discharge pressure can vary only up to the selected maximum pressure of 2,000 psi as limited by high-pressure relief valve 76.

Figure 6:
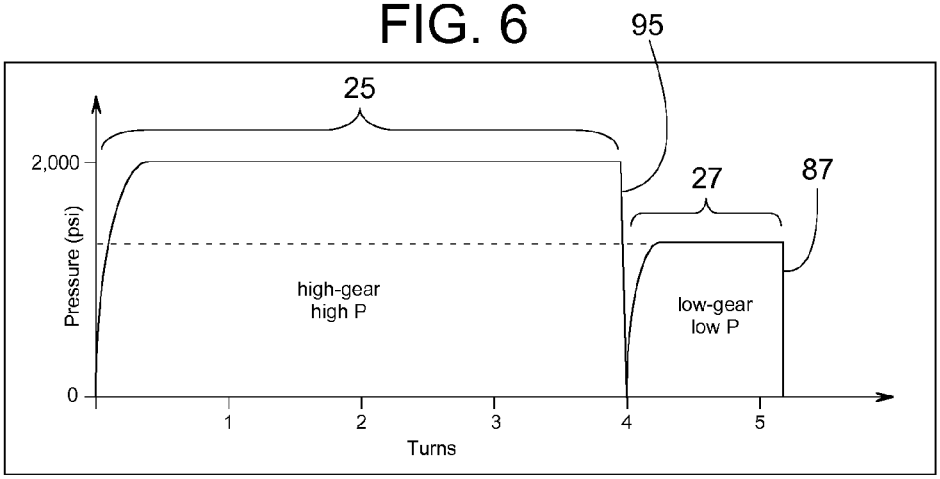
FIG. 6 is a graph of hydraulic pressure versus joint rotation illustrating a joint make-up process.

During initial tightening period 25, as shown in FIGS. 1 and 6, tongs tool 24 quickly tightens connection 12 to a preliminary stopping point 87 as established by some known means. Examples of such means include, but are not limited to, means for sensing a certain hydraulic pressure limit has been reached, means for determining a certain number of revolutions has occurred, means for determining a certain amount of time has passed, means for sensing a certain intermediate torque value has been reached, etc. In some examples, stopping point 87 is simply the result of tongs 24 stalling in high gear. In other words, tongs 24 reaches stopping point 87 when the torque exerted by tongs 24 is insufficient to overcome the rotational resistance of joint 12. Upon reaching the preliminary stopping point 87, tongs system 10 terminates initial tightening period 25. To determine when tongs 24 has stalled, controller 32 monitors an encoder that senses the rotation of a gear or some other rotating member of tongs 24. The encoder failing to detect rotation (e.g., passing gear teeth) over a predetermined period (e.g., one second), indicates that tongs 24 has stalled at intermediate stopping point 87.

At intermediate stopping point 87, immediately following the initial tightening period but before the final tightening period, signals 84*c* and 84*d* are such that they allow valve 66 to return momentarily to its spring biased neutral/stop central position. Valve 66 in its normal central position stops tongs motor 30 and shunts discharge 88 of pump 72 back to its inlet 90 or tank 90' to reduce the pressure at discharge 88. With motor 30 stopped, signal 84*a* shifts transmission 54 from high gear to low gear, i.e., shift tongs tool 24 from its high-gear mode 29 to its low gear mode 31. In some examples, this brief momentary period (transition period) begins the transition to final tightening period 27.

Figure 5:
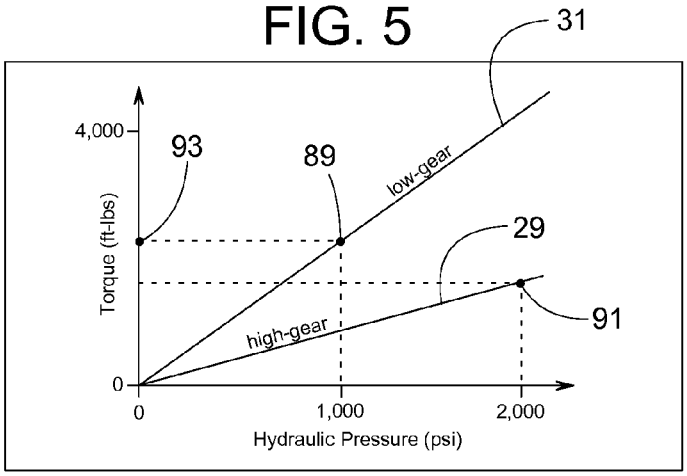
FIG. 5 is a graph of tongs torque versus hydraulic pressure during high-gear and low-gear modes.

During final tightening period 27, shown in FIGS. 2 and 6, signal 84*g* confirms that clutch 36 is disengaged. Signal 84*f* determines that clamp 26 is still in its clamped position. Signal 84*e* maintains backup jaws 56 in its clamping configuration. Signal 84*b* allows a spring 92 to shift valve 80 so as to set hydraulic system 28 in the low-pressure mode by activating low-pressure relief valve 78 and effectively taking high-pressure relief valve 76 out of the circuit. Low-pressure relief valve 78, in some examples, is set at 1,000 psi (selected maximum pressure), thus hydraulic pressure at pump discharge 88 can now only vary up to the selected maximum pressure of 1,000 psi as limited by low-pressure relief valve 78. Signal 84*c* shifts valve 66 to run motor 30 and tongs tool 24 in the forward, tightening direction. In some examples, due to the high and low gear modes provided by transmission 54, greater torque is transmitted from jaws 52 to connection 12 when hydraulic system 28 is in the low-pressure mode than when hydraulic system 28 is in the high-pressure mode. FIG. 5, for example, shows greater torque at a point 89 than at a point 91.

Hydraulic system 28 in the low-pressure mode and transmission 54 and tongs tool 24 in low-gear mode, as shown in FIG. 2, operates tongs system 10 in the final tightening period 27 to properly tighten connection 12 to a predetermined final torque 93. The final torque is predictable because, for a given example of tongs system 10, the final torque is an obtainable function of the hydraulic pressure at discharge 88 and the speed ratio of jaws speed (jaws 52) to motor speed (motor 30). Such a function or relationship is readily used as means for adjustably setting low-pressure relief valve 78 to achieve the desired final torque 93. In some examples, controller 32 relies on such a relationship to display a proper low-pressure setting of relief valve 78 to achieve a desired final torque suitable for the tube string being assembled.

In some examples, a final torque stopping point 95 (FIG. 6) occurs when tongs 24 stalls in low-gear 31 during the low-pressure mode. To determine when tongs 24 has stalled, controller 32 monitors an encoder that senses the rotation of a gear or some other rotating member of tongs 24. The encoder failing to detect rotation (e.g., passing gear teeth) over a predetermined period (e.g., one second) indicates that tongs 24 has stalled at final torque stopping point 95. Upon reaching the final torque stopping point 95, tongs system 10 terminates final tightening period 27 by first reversing rotation of tongs 24 for about one rotation (as sensed by the tongs' encoder) to disengage jaws 52 from joint 12 and then retracting tongs 24 to a position clear of joint 12 and tubing 14.

To unscrew connection 12 for disassembly of tube string 14, signal 84*d* shifts valve 66 to reverse the rotation of motor 30 and jaws 52. Breaking tubular connection 12 can be achieved by various means, examples of which include, but are not limited to, transmission 54 being in high-gear, transmission 54 being in low-gear, hydraulic system 28 being in the high-pressure mode, hydraulic system 28 being in the low-pressure mode, and various combinations and sequences thereof.

Figure 7:
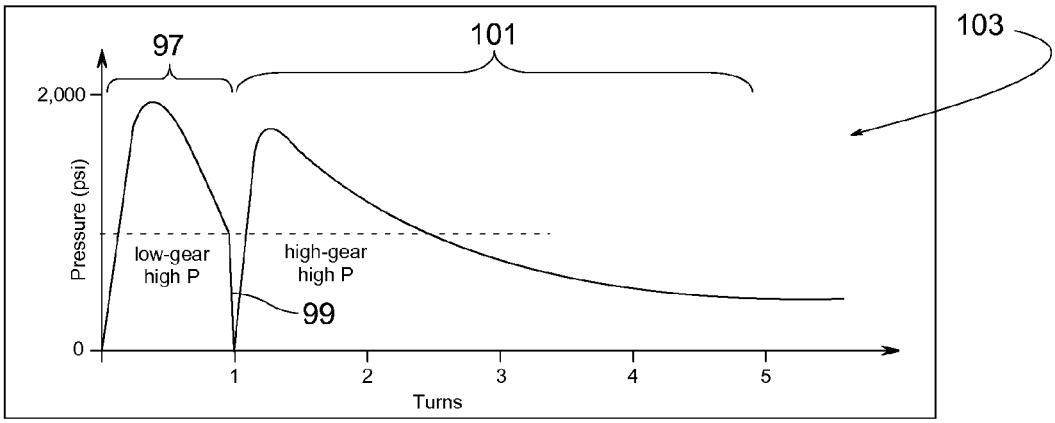
FIG. 7 is a graph of hydraulic pressure versus joint rotation illustrating a joint break-out process.

In an example break-out sequence 103 shown in FIG. 7, unscrewing of connection 12 begins with a first loosening period 97, in low-gear 31, in high-pressure mode (valve 80 as shown in FIG. 1) and with valve 66 shifted to rotate motor 30 in reverse for a predetermined degree of jaw rotation (e.g., one full turn as measured by a tongs' encoder). Tongs 24 pauses for an instant at a stopping point 99. Upon reaching stopping point 99, system 10 prepares for a second loosening period 101, wherein system 10 operates in high-gear 29, in high-pressure mode (valve 80 as shown in FIG. 1) and with valve 66 shifted to rotate motor 30 in reverse. This continues until a person terminates the operation when the person sees that joint 12 is fully disconnected. When joint 12 is fully disconnected, tongs 24 briefly rotates in a forward tightening direction for about one rotation (as sensed by the tongs' encoder) to disengage jaws 52 from joint 12, and then tongs 24 retracts to a position clear of joint 12 and tubing 14.

Although FIGS. 1-3 illustrate a basic example of hydraulic circuit 28, other embodiments include variations of circuit 28. In some examples, high-pressure relief valve 76 always remains connected to pump discharge 88, and instead of valve 80 a simple on-off solenoid valve controlled by controller 32 selectively connects and disconnects low-pressure relief valve 78 to pump discharge 88. When low-pressure relief valve 78 is disconnected, high-pressure relief valve 76 establishes the maximum pressure at discharge 88. When low-pressure relief valve 78 is connected, low-pressure relief valve 78 establishes the maximum pressure at discharge 88 because with both relief valves 76 and 78 connected in fluid communication with discharge 88, the lower pressure setting of low-pressure relief valve 78 prevents the pressure at discharge 88 from ever reaching the higher pressure setting of high-pressure relief valve 76.

Figure 8:
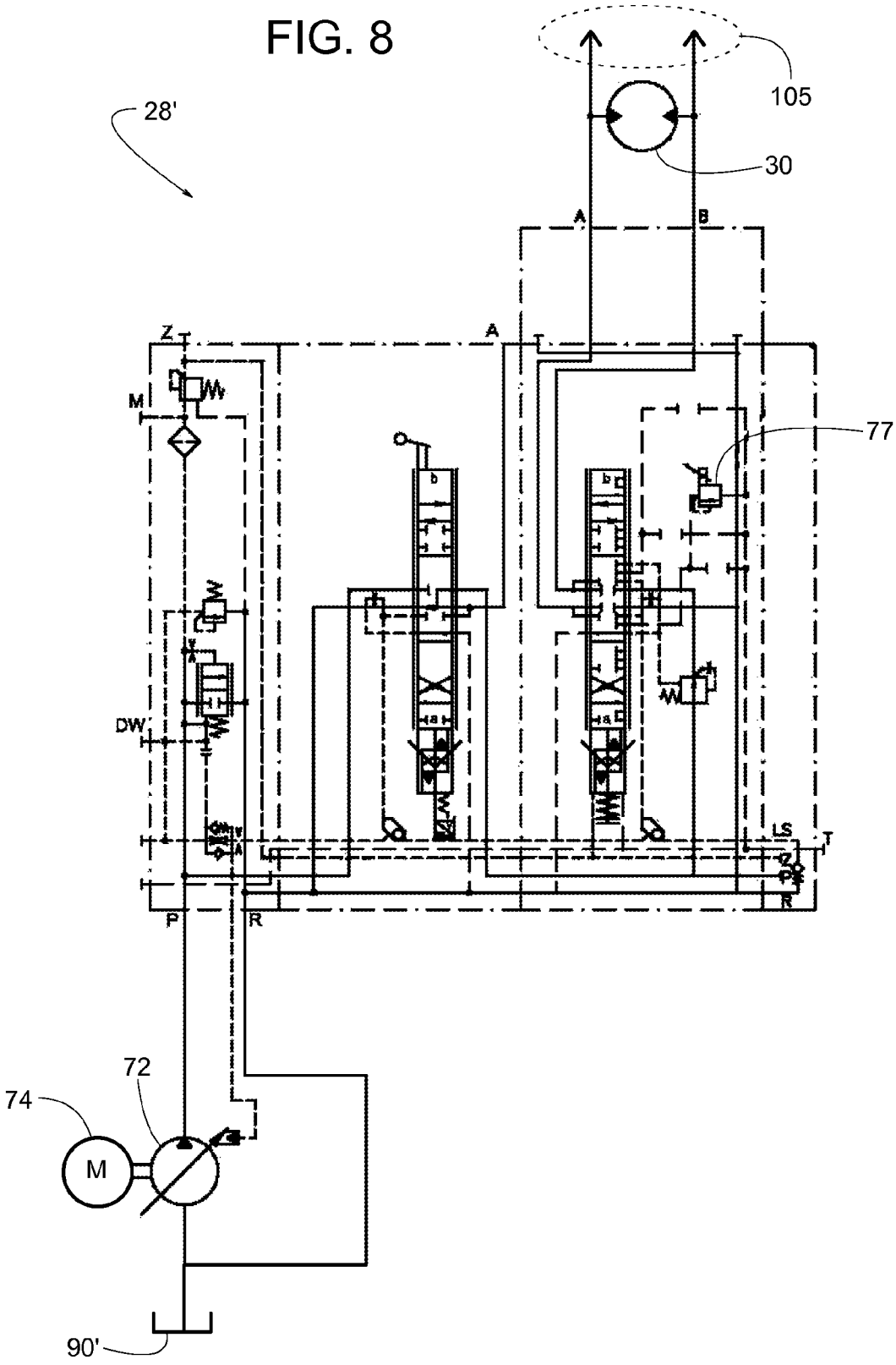
FIG. 8 is a schematic diagram showing an example hydraulic circuit.

In some examples of hydraulic circuit 28, instead of relief valves 76 and 78, a known proportional pressure relief valve is used for setting the desired maximum operating pressures during the high-pressure mode and the low-pressure mode. FIG. 8, for example, shows a hydraulic circuit 28' with such a proportional pressure relief valve 77. In circuit 28', lines 105 connect to a manual control valve of tongs 24. In other examples of hydraulic circuit 28, the desired operating pressures during the high-pressure mode and the low-pressure mode are regulated by a known proportional pressure reducing valve (analogous to an adjustable pressure regulator).

For safety, to prevent tongs 24 from engaging tubing 14 when hoist 22 is lifting or lowering tubing 14 or when clamp 26 releases tubing 14 (creating a possible tubing freefall with tongs 24 attached) system 10 includes some safety interlocks. In some examples, if signal 84*g* indicates that clutch 36 is engaged to activate hoist 22, controller 32 inhibits tongs deployment, engagement and/or rotation of jaws 52. Controller 32 can do this by various means, examples of which include, but are not limited to, signals 84*c* and 84*d* causing valve 66 to shift to its normal central position (FIG. 3). In some examples, if signal 84*f* indicates that clamp 26 has released tube 14*b*, controller 32 inhibits tongs deployment, engagement and/or rotation of jaws 52. Controller 32 can do this by various means, examples of which include, but are not limited to, signals 84*c* and 84*d* causing valve 66 to shift to its normal central position (FIG. 3).

Referring to FIG. 4, a block 94 schematically represents the rotatable set of jaws 52 engaging tubular connection 12, a block 96 schematically represents tongs tool 24 initially screwing together tubular connection 12 during the initial tightening period with hydraulic system 28 operating in the high-pressure mode and tongs tool 24 operating in the high-gear mode. A block 100 schematically represents after initially screwing together tubular connection 12 during the initial tightening period, tongs tool 24 subsequently tightening tubular connection 12 during the final tightening period with hydraulic system 28 operating in the low-pressure mode and tongs tool 24 operating in the low-gear mode. A block 102 schematically represents hydraulic system 28 subjecting hydraulic motor 30 to greater hydraulic pressure during the initial tightening period than during the final tightening period. A block 104 schematically represents high-pressure relief valve 76 establishing the selected maximum pressure of hydraulic system 28 in the high-pressure mode. A block 106 schematically represents low-pressure relief valve 78 establishing the selected maximum pressure of hydraulic system 28 in the low-pressure mode. A block 108 schematically represents tongs tool 24 applying greater torque to tubular connection 12 when hydraulic system 10 is in the low-pressure mode than when hydraulic system 10 is in the high-pressure mode. A block 110 schematically represents inhibiting rotation of rotatable set of jaws 52 when clamp 26, spaced apart from tongs tool 24, releases tube 14*b* beneath tubular connection 12. A block 112 schematically represents inhibiting rotation of the rotatable set of jaws 52 when clutch 36 activates hoist 22 that is coupled to tubular connection 12. A block 98 schematically represents, between the initial tightening period and the final tightening period, momentarily pausing rotation of hydraulic motor 30.

Although the invention is described with respect to a preferred embodiment, modifications thereto will be apparent to those of ordinary skill in the art. The scope of the invention, therefore, is to be determined by reference to the following claims:

The invention claimed is:

1. A tongs system for making a tubular connection during an initial tightening period and a final tightening period following the initial tightening period, the tong system comprising:

a hydraulic system selectively operable in a high-pressure mode and a low-pressure mode, the hydraulic system providing hydraulic pressure variable up to a selected maximum pressure, the selected maximum pressure being greater in the high-pressure mode than in the low-pressure mode;

a tongs tool comprising a rotatable set of jaws, a hydraulic motor, and a transmission coupling the hydraulic motor to the rotatable set of jaws, the rotatable set of jaws being connectable to the tubular connection, the hydraulic motor being connected in fluid communication with the hydraulic system, the transmission rendering the tongs tool selectively operable in a high-gear mode and a low-gear mode, the tongs tool having a speed ratio of jaws speed to motor speed that is higher in the high-gear mode than in the low-gear mode, the tongs tool being in the high-gear mode and the hydraulic system being in the high-pressure mode during the initial tightening period, the tongs tool being in the low-gear mode and the hydraulic system being in the low-pressure mode during the final tightening period, and the hydraulic motor of the tongs tool being driven by greater hydraulic pressure from the hydraulic system during the high-pressure mode than during the low-pressure mode; and a clamp below and spaced apart from the tongs tool, the clamp having selectively a clamp mode and a release mode, the clamp in the clamp mode being in clamping engagement with a tube associated with the tubular connection, the clamp in the release mode being unclamped from the tube, the hydraulic motor being inhibited from rotating when the clamp is in the release mode while the tongs tool is above the clamp.

2. The tongs system of claim 1, wherein the hydraulic motor defines a fluid inlet in fluid communication with the hydraulic system, the fluid inlet being at greater hydraulic pressure during the initial tightening period than during the final tightening period.

3. The tongs system of claim 1, further comprising:

a high-pressure relief valve being part of the hydraulic system, the high-pressure relief valve establishing the selected maximum pressure of the hydraulic system in the high-pressure mode; and a low-pressure relief valve being part of the hydraulic system, the low-pressure relief valve establishing the selected maximum pressure of the hydraulic system in the low-pressure mode.

4. The tongs system of claim 1, wherein greater torque is transmitted from the rotatable set of jaws to the tubular connection when the hydraulic system is in the low-pressure mode than when the hydraulic system is in the high-pressure mode.

5. The tongs system of claim 1, further comprising:

a hoist coupled to the tubular connection; and a clutch associated with the hoist, the clutch being selectively engaged to activate the hoist and disengaged to deactivate the hoist, the hydraulic motor being inhibited from rotating when the clutch is engaged.

6. A tongs method for making a tubular connection during an initial tightening period and a final tightening period, the tongs method involving the use of a tongs tool powered by a hydraulic system that provides hydraulic pressure variable up to a selected maximum pressure, the hydraulic system being selectively operable in a high-pressure mode and a low-pressure mode, the selected maximum pressure being greater in the high-pressure mode than in the low-pressure mode, the tongs tool comprising a rotatable set of jaws, a hydraulic motor, and a transmission coupling the hydraulic motor to the rotatable set of jaws, the transmission rendering the tongs tool selectively operable in a high-gear mode and a low-gear mode, the tongs tool having a speed ratio of jaws speed to motor speed that is higher in the high-gear mode than in the low-gear mode, the tongs method comprising:

the rotatable set of jaws engaging the tubular connection;

the tongs tool initially screwing together the tubular connection during the initial tightening period with the hydraulic system operating in the high-pressure mode and the tongs tool operating in the high-gear mode; and after initially screwing together the tubular connection during the initial tightening period, the tongs tool subsequently tightening the tubular connection during the final tightening period with the hydraulic system operating in the low-pressure mode and the tongs tool operating in the low-gear mode, the hydraulic motor of the tongs tool being driven by greater hydraulic pressure from the hydraulic system during the high-pressure mode than during the low-pressure mode.

7. The tongs method of claim 6, further comprising the hydraulic system subjecting the hydraulic motor to greater hydraulic pressure during the initial tightening period than during the final tightening period.

8. The tongs method of claim 6, wherein the hydraulic system includes a high-pressure relief valve and a low-pressure relief valve and further comprising:

the high-pressure relief valve establishing the selected maximum pressure of the hydraulic system in the high-pressure mode; and the low-pressure relief valve establishing the selected maximum pressure of the hydraulic system in the low-pressure mode.

9. The tongs method of claim 6, the tongs tool applying greater torque to the tubular connection when the hydraulic system is in the low-pressure mode than when the hydraulic system is in the high-pressure mode.

10. The tongs method of claim 6, further comprising inhibiting rotation of the rotatable set of jaws when a clamp spaced apart from the tongs tool releases a tube beneath the tubular connection.

11. The tongs method of claim 6, further comprising inhibiting rotation of the rotatable set of jaws when a clutch activates a hoist that is coupled to the tubular connection.

12. The tongs method of claim 6, further comprising:

between the initial tightening period and the final tightening period, momentarily pausing rotation of the hydraulic motor.

13. A tongs method for making a tubular connection during an initial tightening period and a final tightening period, the tongs method involving the use of a tongs tool powered by a hydraulic system that provides hydraulic pressure variable up to a selected maximum pressure, the hydraulic system being selectively operable in a high-pressure mode and a low-pressure mode, the selected maximum pressure being greater in the high-pressure mode than in the low-pressure mode, the tongs tool comprising a rotatable set of jaws, a hydraulic motor, and a transmission coupling the hydraulic motor to the rotatable set of jaws, the hydraulic motor of the tongs tool being driven by greater hydraulic pressure from the hydraulic system during the high-pressure mode than during the low-pressure mode, the transmission rendering the tongs tool selectively operable in a high-gear mode and a low-gear mode, the tongs tool having a speed ratio of jaws speed to motor speed that is higher in the high-gear mode than in the low-gear mode, the tongs method comprising:

the rotatable set of jaws engaging the tubular connection;

the tongs tool initially screwing together the tubular connection during the initial tightening period with the hydraulic system operating in the high-pressure mode and the tongs tool operating in the high-gear mode;

after initially screwing together the tubular connection during the initial tightening period, the tongs tool subsequently tightening the tubular connection during the final tightening period with the hydraulic system operating in the low-pressure mode and the tongs tool operating in the low-gear mode;

the tongs tool applying greater torque to the tubular connection when the hydraulic system is in the low-pressure mode than when the hydraulic system is in the high-pressure mode; and the hydraulic system subjecting the hydraulic motor to greater hydraulic pressure during the initial tightening period than during the final tightening period.

14. The tongs method of claim 13, wherein the hydraulic system includes a high-pressure relief valve and a low-pressure relief valve and further comprising:

the high-pressure relief valve establishing the selected maximum pressure of the hydraulic system in the high-pressure mode; and the low-pressure relief valve establishing the selected maximum pressure of the hydraulic system in the low-pressure mode.

15. The tongs method of claim 13, further comprising inhibiting rotation of the rotatable set of jaws when a clamp spaced apart from the tongs tool releases a tube beneath the tubular connection.

16. The tongs method of claim 13, further comprising inhibiting rotation of the rotatable set of jaws when a clutch activates a hoist that is coupled to the tubular connection.

17. The tongs method of claim 13, further comprising:

between the initial tightening period and the final tightening period, momentarily pausing rotation of the hydraulic motor.

* * * * *